US008540548B2

(12) United States Patent
Pedersen et al.

(10) Patent No.: US 8,540,548 B2
(45) Date of Patent: Sep. 24, 2013

(54) CHILD'S ACTIVITY TOY AND DISC DISPENSER THEREFOR

(75) Inventors: Bradley D. Pedersen, Mississauga (CA); Kyle Jeffs, Mississauga (CA)

(73) Assignee: Tech 4 Kids, Inc., Ontario (CA)

( * ) Notice: Subject to any disclaimer, the term of this patent is extended or adjusted under 35 U.S.C. 154(b) by 150 days.

(21) Appl. No.: 13/253,037

(22) Filed: Oct. 4, 2011

(65) Prior Publication Data

US 2012/0171921 A1 Jul. 5, 2012

Related U.S. Application Data

(60) Provisional application No. 61/389,680, filed on Oct. 4, 2010.

(51) Int. Cl.
*A63H 37/00* (2006.01)
*A63H 33/30* (2006.01)

(52) U.S. Cl.
USPC ..... 446/475; 446/75

(58) Field of Classification Search
USPC ..... 446/71, 75, 76, 146, 475, 491; 124/16, 124/26, 66
See application file for complete search history.

(56) References Cited

U.S. PATENT DOCUMENTS 4,360,988 A * 11/1982 Schoenfield et al. ..... 446/424
5,318,469 A * 6/1994 Unalp et al. ..... 446/73
5,562,328 A * 10/1996 Schottenfeld ..... 312/35
6,206,009 B1 * 3/2001 Paxson ..... 132/73

* cited by examiner

*Primary Examiner* — Kien Nguyen
(74) *Attorney, Agent, or Firm* — Adam K. Sacharoff

(57) ABSTRACT

A child's activity toy comprises a plurality of dispensers which will dispense circular discs onto a flat magnetic surface. The circular discs are of different colors, each color having its own respective diameter, with the color being applied to each side of the discs. Each dispenser is specific to its own color, and is biased to its closed, non-dispensing condition. Pressing the dispensing end of a dispenser against the flat magnetic surface will dispense a circular disc; and moving the dispenser while it is pressed against the flat magnetic surface will dispense a series of circular discs. A frame is provided for the flat magnetic surface, and includes a graduated sorter so as to separate the discs of one color from the discs of any other color. The respective dispenser for each color can be filled with the discs from the respective sorter chamber.

10 Claims, 8 Drawing Sheets

CHILD'S ACTIVITY TOY AND DISC DISPENSER THEREFOR

FIELD OF THE INVENTION

This invention relates to a child's activity toy, and particularly to such a toy that comprises a planar surface fixed in a frame, and at least one and usually a plurality of dispensers that will dispense coloured discs onto the planar surface, when the dispensers are activated by being pressed against the planar surface. The discs may be dispensed one at a time, or if the dispenser is held against the planar surface and moved at the same time the discs will be dispensed seriatim. The frame is also provided with a sorting system to sort the coloured discs into groups for each colour, and to refill the respective dispensers for each respective colour.

BACKGROUND OF THE INVENTION

Children enjoy drawing, painting, and playing with bright and multiple coloured toys and other pieces. Numerous designs are known for providing simple activity centres or drawing tools comprising a flat board onto which paper, or the like can be attached and onto which, a child can attached letters, shaped designs, or the like, or draw free-hand to produce an image.

While these types of devices are generally well received by most children, it would still be advantageous to provide an alternative activity toy that would allow the child to "paint" a picture using brightly coloured pieces, and then be able to collect, sort and re-use those pieces to produce additional images.

In our co-pending U.S. patent application No. 61/389,680, we have previously described such a toy, and the contents of that document are incorporated herein, by reference.

The present inventors have now discovered improved methods of dispensing the coloured pieces, or "discs" using specifically designed dispensers, and have also provided improved methods for collecting and sorting of the discs so that they can be placed back into the appropriate dispenser—ready for re-use.

As such, a child of at least three or four years of age may be trained to fully enjoy the toy by learning how to remove coloured discs from its planar surface, sort them by colour using an aspect of the present invention to be taught hereafter, and refilling the specific dispensers with specific designated colours, also using an aspect of the present invention to be taught hereafter. This teaches the child such matters as self-discipline, eye-hand coordination, patience, and visual enjoyment.

SUMMARY OF THE INVENTION

In accordance with one aspect of the present invention, there is provided a dispenser for dispensing circular discs onto a surface, when activated, comprising:

a generally cylindrical outer sleeve and a substantially cylindrical dispenser tube located within said outer sleeve, each of which has a first end and a second end;

first and second end sleeve rings (or caps) located at the respective first and second ends of the outer sleeve; and spring means within said outer sleeve to bias said dispenser tube within said outer sleeve.

The interior wall of the outer sleeve has:

a first recess formed therein near the first end;

first and second bearing rings formed at each end of the outer sleeve, and a third bearing ring formed at the end of the first recess distal from the first end;

and a pair of wedge shaped guide probes extending from the second end of the outer sleeve, and arranged 180° from each other.

The first and second end sleeve rings are fitted to the two ends of the outer sleeve, but the length of the dispenser tube is greater than the combined length of the outer sleeve and the end sleeve caps so that it preferably extends beyond the first and second ends of the dispenser tube.

The dispenser tube is adapted to slide within the outer sleeve, and is biased in one direction, by said spring. The dispenser tube slides against the bearing rings on the outer sleeve. A stop ring is formed on the outer surface of the dispenser tube in a location so as to be received into said first recess, and so as to cooperate with the side of the third bearing ring closest to the first end of the outer sleeve so as to limit the sliding motion of the dispenser tube in the direction towards the second end of the outer sleeve.

The spring activation means is preferably a coil spring fitted into the first recess and surrounding a portion of the outer perimeter of the dispenser tube so as to bias the position of the dispensing tube in a direction towards the second end of the outer sleeve.

A pair of guide slots is formed lengthwise in the dispensing tube at the second end thereof, and each extends towards the first end to a position near the mid-point of the length of the outer sleeve, and a portion of the guide slots is adapted to receive the respective guide probe therein, and wherein the end of each portion closest to the second end of the dispenser tube is adapted to cooperate with the respective guide probe to force the outer end of each respective guide slot to spread apart when the second end of the dispenser tube is pressed so as to cause movement thereof along the outer sleeve and the end sleeve caps towards the first end of the outer sleeve against the bias force of the spring activation means.

A further pair of slots is formed lengthwise in the dispensing tube in positions intermediate of the pair of guide slots, and to the same length of the guide slots.

An interference ring is formed on the outer surface of the dispenser tube near the second end thereof so as to limit the sliding motion of the dispenser tube in a direction towards the second end of the outer sleeve; and a conical wedge surface is formed sloping inwardly from the side of the interference ring closest to the second end, towards the second end.

A mating wedge surface is formed on the inner surface of the second end sleeve, sloping outwardly from near the end surface of the second end sleeve and away therefrom.

The cooperation between the conical wedge surface and the mating wedge surface together with the bias force of the spring activation means, acts to maintain the segments at the second end of the dispenser tube in contiguous positions and thereby so as to maintain the dispenser is in its non-dispensing condition.

When the dispenser is activated, by causing movement of the dispenser tube towards the first end of the outer sleeve and the first end sleeve, against the bias force of the spring activation means, the cooperation between the conical wedge surface and the mating wedge surface is overcome so that the contiguous segments are permitted to spread apart one from the other, and thus create a position wherein the dispenser is in its dispensing condition.

The end surfaces of the first pair of segments thereof which are opposite each other extend further away from the second end of the second end sleeve than the end surfaces of the second pair of segments thereof which are opposite each other and intermediate of the first pair of segments.

The inside diameter of the dispenser tube is formed to a predetermined dimension so as to accommodate circular discs of a corresponding diameter.

The dispenser tube is preferably transparent, or translucent, and a viewing slot is formed lengthwise along a portion of the outer sleeve between the second and third bearing rings, so as to permit viewing of circular discs that may be stacked in the dispenser tube.

Preferably, each circular disc accommodated in the respective dispenser tube has a specific colour applied to the top and bottom surfaces thereof, and preferably, all or a portion of the dispenser tube is colour coordinated in the same, or a corresponding colour.

Each circular disc accommodated therein is made from a material which is susceptible to magnetism.

When the segments of the dispenser tube is pressed against a surface, the segments are moved so as to create an opening larger than the discs. As such, the magnetic attraction between the discs and the surface cause a disc to be dispense. Preferably, one of the second pair of segments of the dispenser tube is aligned and creates a opening larger than the discs, so that when the dispenser is activated and moved along a flat surface, a plurality of circular discs are dispensed therefrom, seriatim.

At least one dispenser as described above, and a flat magnetic surface incorporated into a frame, form a rudimentary embodiment of a child's activity toy, as described previously in U.S. 61/389,680.

The child's activity toy preferably comprises a plurality of dispensers, as described above, each having a dispenser tube with a differing interior diameter than the other dispensers, and each preferably accommodating a plurality of circular discs having a corresponding colour to the respective dispenser tube therein.

The frame of the child's activity toy has a graduated sorter for collection of the discs, once applied, and which sorter is preferably is located below the flat magnetic surface, and the function of the sorter is described hereinbelow. While various sorting systems might be used, a preferred embodiment of the sorting system is now described.

A collector slot is placed at one edge of the flat magnetic surface in communication with a collector chute in the graduated sorter, and a collection chamber is in communication with the collector chute, so that when the frame is in a horizontal disposition, and the circular discs are pushed through the collector slot, they will fall into the collection chute.

When the frame is then moved into a vertical disposition with the collector chute at the top, the circular discs will fall from the chute, into the collection chamber.

A plurality of sorting chambers is placed below the collection chamber, and these chambers are separated from each contiguous sorting chamber by one or a plurality of separator plates having a plurality of holes therein, wherein the holes in each consecutive separator plate are smaller than in the separator plate which is next above, and wherein the diameters of the respective holes in the respective separators plates are sufficient to allow all circular discs to fall therethrough except the discs of the specific diameter which is larger than the diameter of the holes in that specific separator plate.

Upon gentle shaking of the frame, all of the circular discs which are in the collection chamber will thus pass through the separator plates with larger diameter openings than the disc diameter, and thus, the discs will ultimately be sorted into the respective sorting chambers. As a result, after gentle shaking of the device, all circular discs of the specific diameter and colour will be positioned in their respective sorting chamber.

The child's activity toy also comprises a plurality of compartments which are formed in the frame, where each compartment accommodates a specific dispenser for a specific designated colour.

A plurality of sliding gate latches is placed in a dispensing separator so as to allow, and control, communication between each respective specific dispenser and its respective sorting chamber.

The lengthwise dimension of each compartment is predetermined so as to hold the dispensers, and position each dispenser within the compartment. In particular, the compartment includes opening ridges which act against the contiguous segments at the end of the inner tube of the dispenser, and move the segments to the open position. In this position, the dispenser is positioned so that the discs can be inserted back into the dispenser.

When the frame is turned into a vertical disposition with the compartments and respective dispensers at the bottom, all the circular discs in any sorting chamber in which the gate latch has been moved to its open position will fall into the respective dispensing tube of each respective dispensing tube of each respective dispenser.

Moreover, removal of any dispenser from its respective compartment will de-activate that dispenser, so that the dispenser will once again assume its non-dispensing condition.

In one embodiment of the present invention, the coloured image may be viewed by the child using three dimensional (3D) imaging technology. In particular, in the preferred embodiment, the child uses a type of three dimensional imaging technology known as "Chromadepth" imaging technology, which was developed by American Paper Optics. This technique produces a 3D effect based upon differences in the diffraction of colour through a special prism-like holographic film which is typically fitted into glasses worn by the viewer.

In the present invention, the discs are preferably coloured using different colours so that the result image has a 3D effect when viewed through Chromadepth glasses. The use of fluorescent pigments can also enhance this effect. As such, in a preferred embodiment, the image is viewed with Chromadepth glasses wherein at least some of the coloured discs are coloured using fluorescent pigments.

Moreover, if the image is viewed under Ultraviolet (UV) light, it may be still further enhanced.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS

The novel features which are believed to be characteristic of the present invention, as to its structure, organization, use and method of operation, together with further objectives and advantages thereof, will be better understood from the following discussion.

Figure 1:
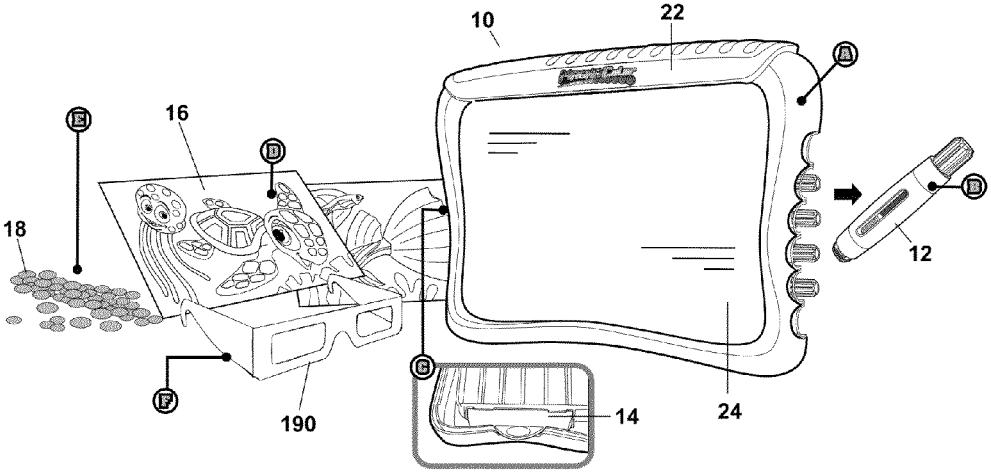
FIG. 1 is an overall view of the components which may be packaged together in a commercial embodiment of the child's activity toy according to the present invention.

Turning first to FIG. 1, an overall view of the components which are generally packaged together in a current embodiment of the child's activity toy in keeping with the present invention shows a tablet 10, a dispensing pen 12, a screen swiper 14, a plurality of pre-printed stencils 16 that may be provided, a plurality of coloured discs 18 (which are generally provided in several colours, as described hereafter), and a pair of "Chromadepth" glasses 190 to appreciate the three-dimensional imaging technology as described above.

Figure 2:
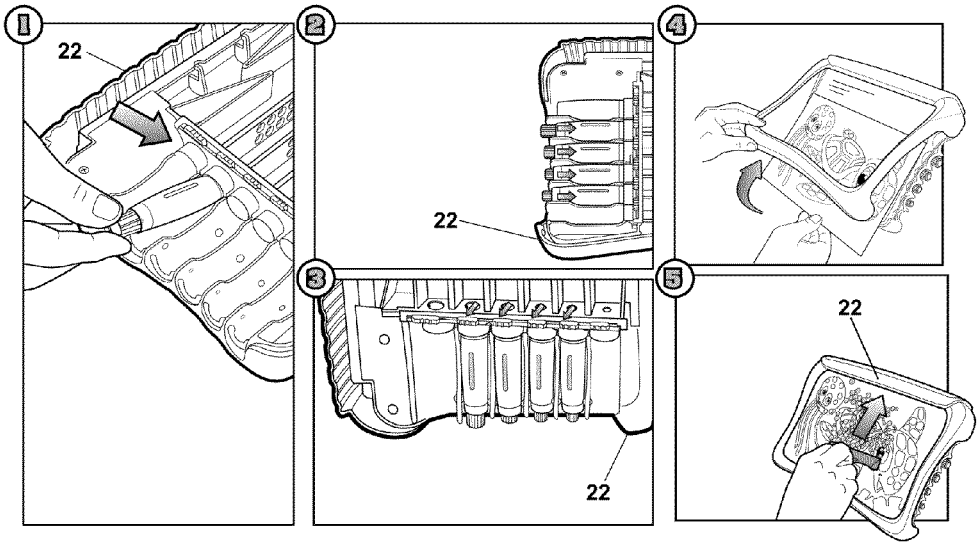
FIG. 2 is a brief illustrated description of several actions required to prepare the activity toy for use by a child.

FIG. 2 shows, in five frames which are numbered 1 to 5, several preliminary actions which may be required to set the activity toy of the present invention into condition for use by a child. The instructions originally in each frame described the steps to be taken quite well, and were as follows:

Frame 1: "To start filling the pens with the 3-D Magic Dots, each pen into the compartment with the latch that is the same colour as the pen cap. Make sure the clear window is facing up."

Frame 2: "Holding the main body of the pen, insert the writing tip into the refill position. When the pen is inserted correctly you will feel it click into the slot. NOTE. Each Magic pen will only fit into the correct slot. If the pen is not 'clicking' into position check to make sure the colour of the pen is the same as the latch."

Frame 3: "Once all the pens are in place, close the compartment spice sliding each latch across to the left side."

Frame 4: "You can draw right on the screen or lift up the frame and insert a design stencil to colour."

Frame 5: "for all the 3-D Magic Dots on the stencil. Use the screen swiper to slide the 3-D Magic Dots to the top of the 3-D design tablet. Make sure all 3-D Magic Dots go through the slot at the top."

Figure 3:
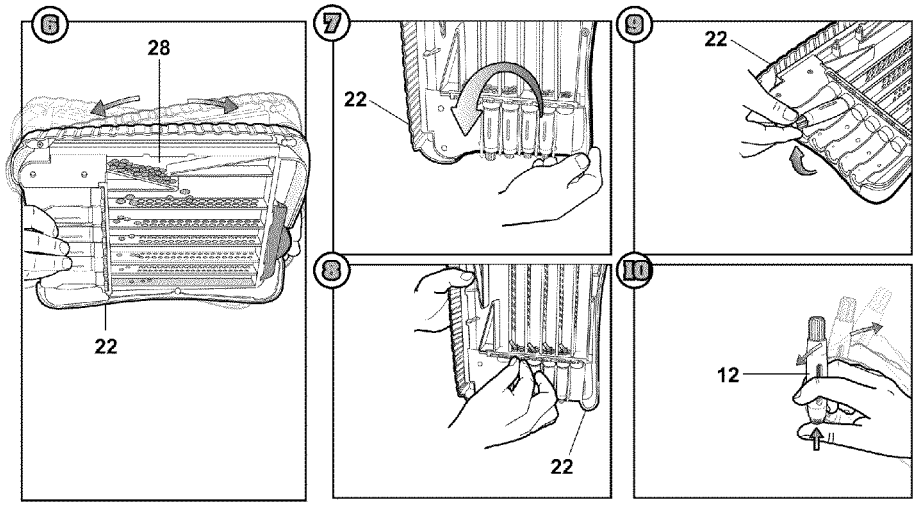
FIG. 3 is a brief illustrated this reaction of the manner by which coloured discs may be sorted and their respective dispensers filled.

Further steps are described in FIG. 3, to sort the coloured discs, to load the dispensers, and to prepare them for dispensing their respective coloured discs, and were as follows:

Frame 6: "Gently shake the design tablet left to right and you will see the coloured dots separate into their proper roles. Continue to shake until all the colours have separated."

Frame 7: "Turn the 3-D design tablet counterclockwise."

Frame 8: "Open up all four pin compartments by moving the latches to the right so that the 3-D Magic Dots fall into the Magic Dot pens."

Frame 9: "Before you start removing the pens, slide the compartment doors to the closed position. Remove the pen by lifting up on the end."

Frame 10: "To make sure that the 3-D Magic Dots are lined up, place your finger over the writing tip and gently shake up and down. You will be able to see through the clear window whether any of the dots are tilted."

Figure 4:
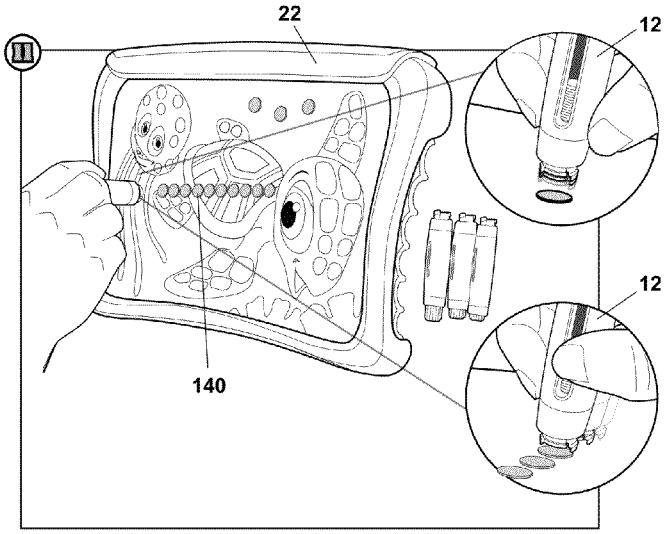
FIG. 4 is a general view showing the manner of operation of the child's activity toy.
Figure 5:
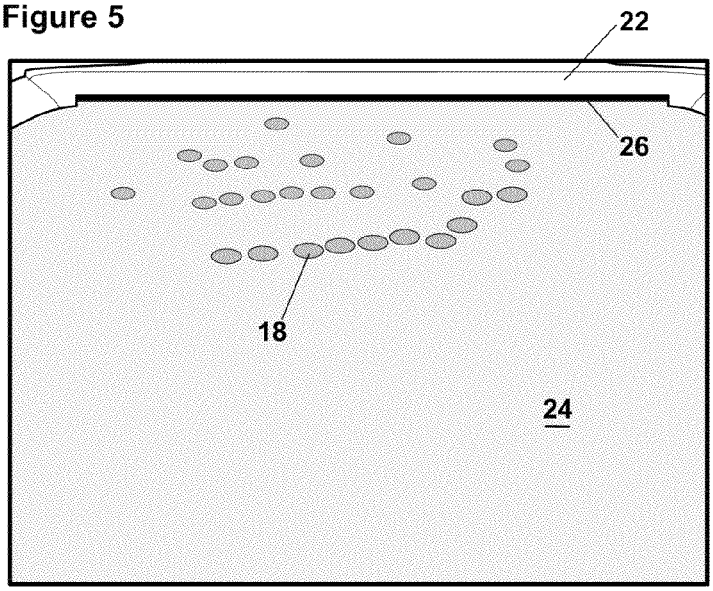
FIG. 5 is a perspective view of a few coloured discs distributed on the planar surface of the toy.

FIG. 4 shows several modes of operation of the dispensers 12, with appropriate narration. In particular, it will be noted that in the upper right corner of the figure there is stated "Press down gently in one spot to release a single 3-D Magic Dot."; And in the lower right corner of the figure there is stated "Press down gently and slide the pen across the screen to release a series of 3-D Magic Dots."

Figure 6:
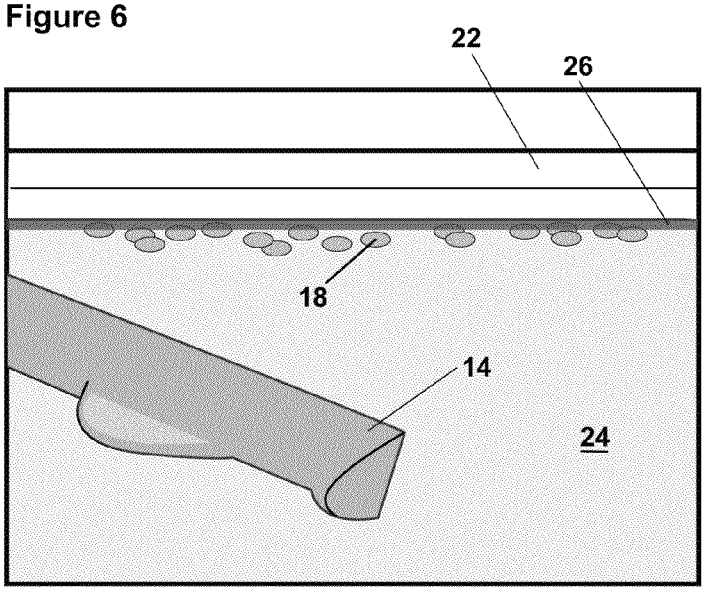
FIG. 6 is a perspective view showing a few coloured discs being pushed into a sorting slot.

The tablet 10 comprises a frame 22 which may be hinged at the top edge thereof so as to permit placement of differing stencils or blank pages into the frame, as seen in FIG. 2, Frame 4. On the upper side of the frame 22 there is a planar surface 24, which is preferably made from a magnetic material. At the top edge of the planar surface 24 there is a collector slot 26, through which the coloured discs 18 which have been placed on the planar surface 24 may be pushed, particularly as seen in FIG. 6. At the under side of the frame 22 there is a graduated sorter mechanism shown generally in FIG. 3, Frame 6, at 28.

The coloured discs 18 are distinguished by being made from a material which is susceptible to magnetism, usually steel. They may have a diameter ranging from 2 mm up to about 6 mm in a usual embodiment of the present invention, and a thickness ranging from about 0.5 mm up to about 2 mm. All of the coloured discs 18 of any specific diameter will be coloured under top and bottom surfaces by having a specific colour applied thereto, such as by painting, coating, having a coloured paper or plastic disc adhered thereto. The discs are typically coloured before being punched from a sheet of materials, but other methods are also possible.

In a typical commercial embodiment of a child's activity toy in keeping with the present invention, four dispensers are provided having four different colours; and typically, those colours are red, orange, yellow, and green, ranging from the largest coloured discs 18 to the smallest coloured discs 18 in four specific diameters thereof. However, it will be clear that additional disc sizes can be provided, and additional dispensers can be provided.

Figure 7:
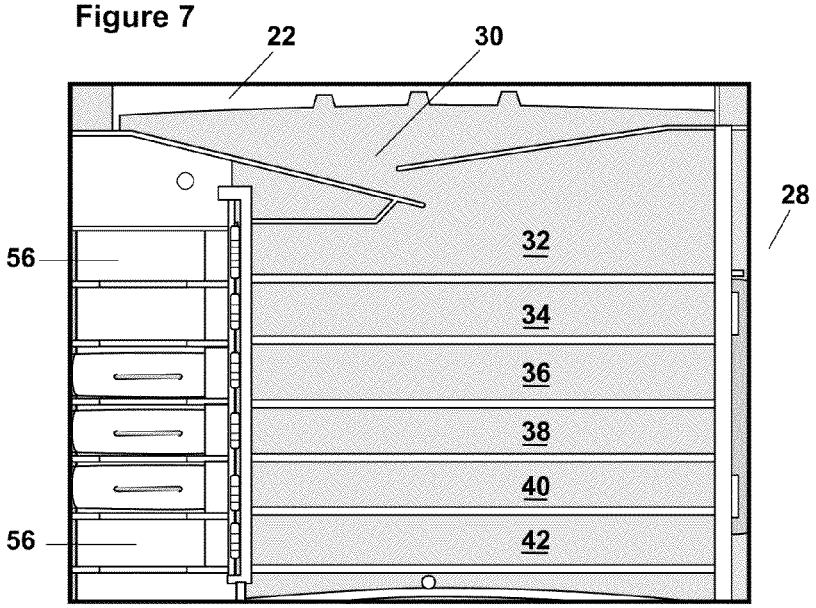
FIG. 7 is a view of the underneath side of the toy showing the overall sorting mechanism assembly.
Figure 8:
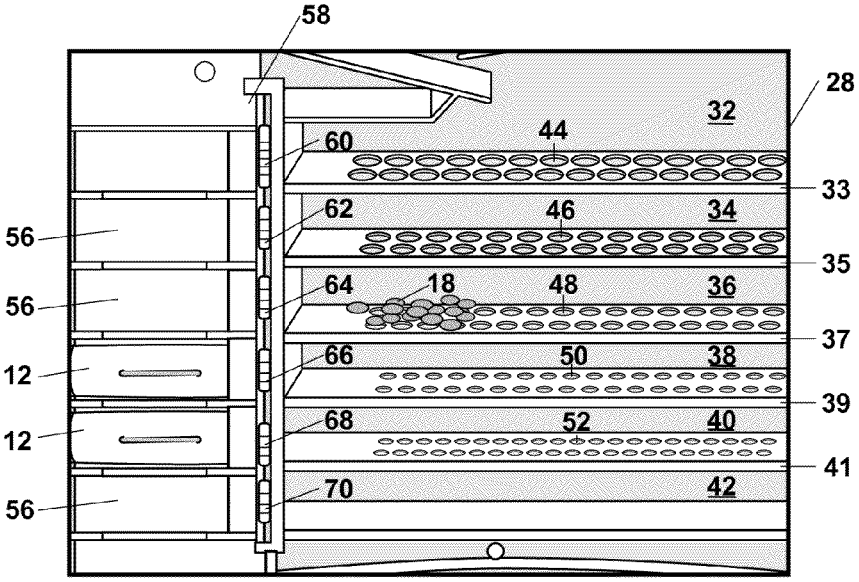
FIG. 8 is a closer view similar to FIG. 7, showing some coloured discs that have been sorted.

Referring now to FIGS. 7 and 8, the arrangement of the graduated sorter 28 will now be described. First, the graduated sorter 28 comprises a collector chute 30 which is in communication with the collector slot 26. The collector chute 30, in turn, is in communication with the collection chamber 32. It will be understood that when the frame 22 is placed in a horizontal disposition, and the coloured discs 18 are pushed through the collector slot 26 by screen swiper 14, the circular discs 18 will fall into the collection chute 30. Then, when the frame 22 is placed into a vertical disposition, as indicated in FIGS. 7 and 8, the circular discs will fall into the collection chamber 32. Now it will be seen in FIGS. 7 and 8, that there are a plurality of sorting chambers 34, 36, 38, 40, and 42, which are below the collection chamber 32 and which are separated one from the other by respective separators 33, 35, 37, 39, and 41. Moreover, it will be seen that each of the separators as a plurality of holes in them, designated at 44, 46, 48, 50, and 52. The size of those holes decreases from each sorting chamber to the next one below, so that only coloured discs having a diameter which is less than the respective holes in any separator will pass through the separator to the next separator chamber. Thus, gentle shaking of the frame will cause all of the circular discs which are in the collection chamber 32 to be sorted into their respective sorting chambers, with all circular discs of a specific diameter and colour being in their respective sorting chamber.

In FIG. 8, a plurality of orange discs 18 is shown having been collected in sorting chamber 36 above the respective separator 37. It will be understood, of course, that passage of those orange coloured discs 18 through separator 37 to sorting chamber 38 has been precluded because the diameter of each of those orange coloured discs 18 is greater than the diameter of the respective holes 48 in separator 37.

It will also be seen in FIGS. 7 and 8 that there are a plurality of compartments 56 formed in the frame 22; and that the compartments 56 are separated from the sorter 28 by a dispensing separator 58. There are a plurality of sliding gate latches 60, 62, 64, 66, 68, and 70, which are placed in the dispensing separator 58, and by setting the respective sliding gate latches appropriately, communication is provided between a respective sorting chamber and the respective dispenser 12 which is placed in the appropriate compartment 56. This is particularly shown in FIGS. 9 and 10.

Figure 9:
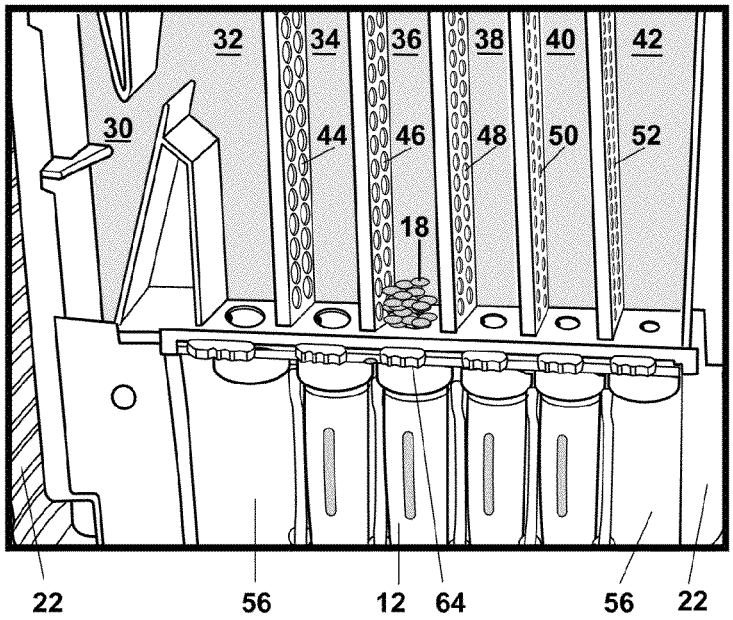
FIG. 9 is a closer view showing the sorted discs of FIG. 7, ready to be filled into a dispenser.

FIG. 9 shows the frame 22 having been upended into a vertical disposition with the compartments 56 and respective dispensers 12 at the bottom. FIG. 9 also shows a plurality of orange coloured discs 18 in sorting chamber 36. The respective sliding gate latch 64 has been opened by being slid to the right as seen in the figure.

Figure 10:
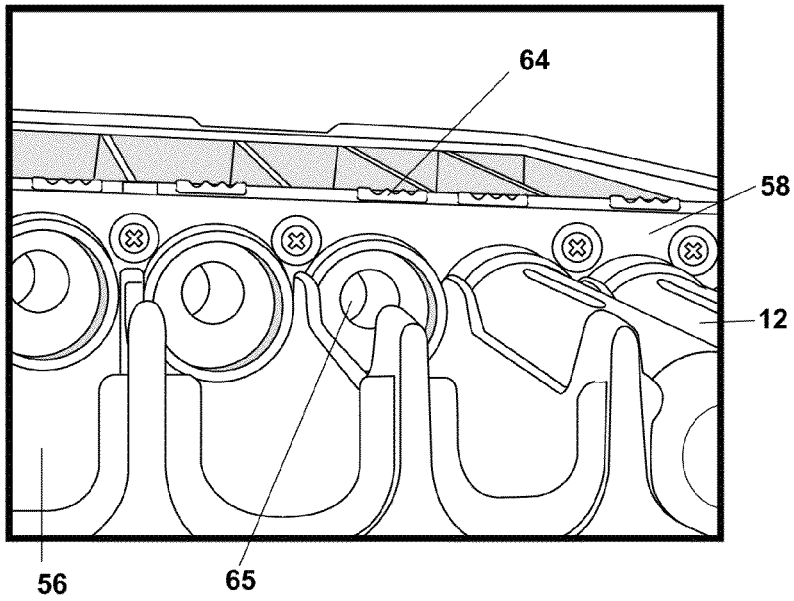
FIG. 10 is a view showing a plurality of sliding gate latches.

It will be seen in FIG. 10 that by sliding the sliding gate latch 64 to the right, an opening 65 has been revealed so as to allow the orange coloured discs 18 to move from the sorting chamber 48 to the respective dispenser 12.

It should also be noted that the lengthwise dimension of each compartment 56 is predetermined so that the dispensers 12 will be activated—that is, put into their dispensing condition—when the dispensers are placed into the respective compartments. The dispensing and non-dispensing conditions of the dispensers 12 are discussed hereafter.

Moreover, it should be noted that not only are the diameters of respective coloured discs 18 different from colour to colour, the diameters of the respective dispensers 12 differ in keeping with the diameter of the coloured discs with which they are intended to be used. Thus, the dimensions of the respective compartments 56 differ so as to accommodate the differing diameters of the respective dispensers 12. It will be understood from the above discussion that the four dispensers 12 which will communicate with sorting chambers 34, 36, 38, and 40, will thereby be intended to dispense coloured discs having the colours red, orange, yellow, and green, respectively.

Turning now to FIGS. 11, 12, 13, 14, and 15, a more detailed discussion of the dispenser 12 of the present invention now follows.

Figure 11:
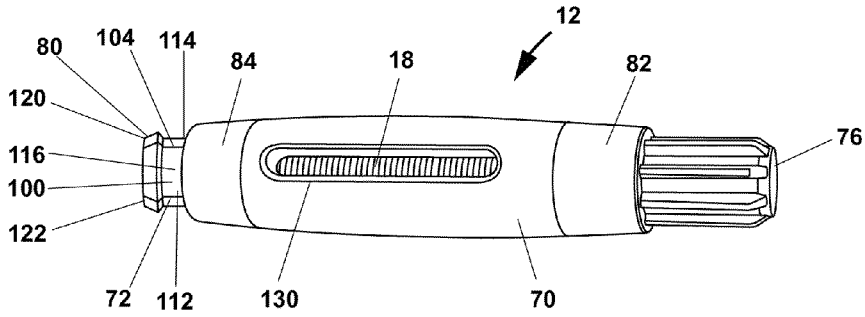
FIG. 11 is a of a dispenser in keeping with the present invention.
Figure 12:
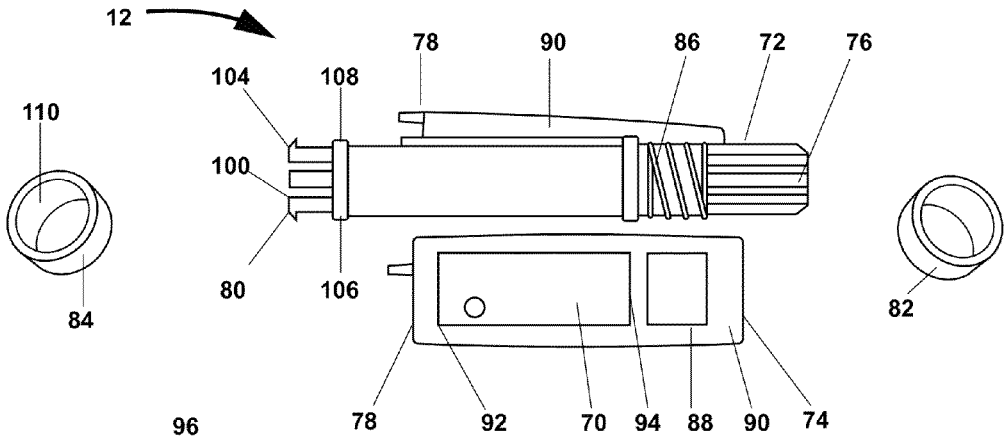
FIG. 12 is a view showing a disassembled dispenser with the dispenser tube and spring activation means in place.
Figure 13:
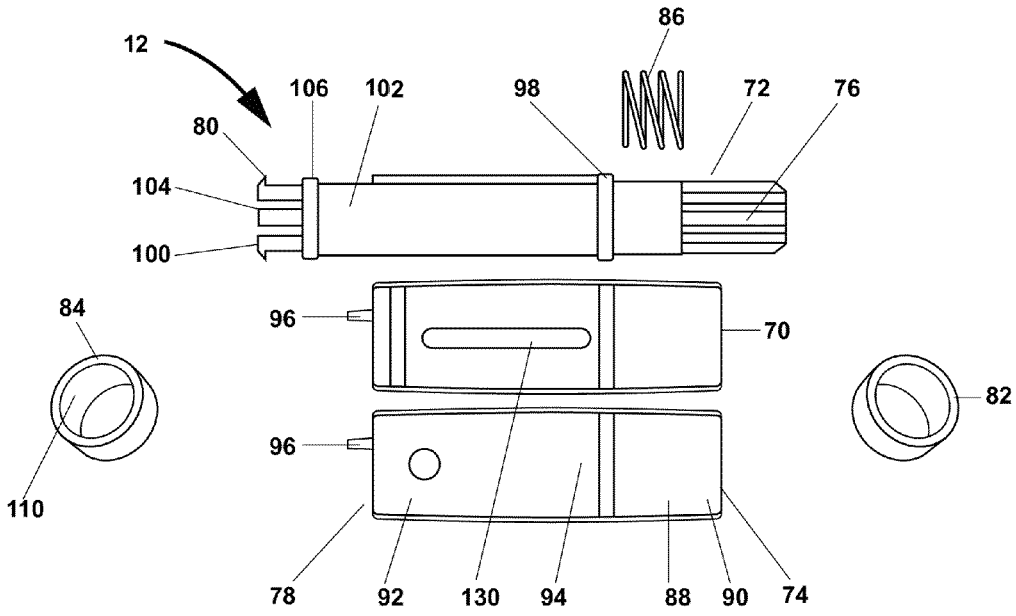
FIG. 13 is a view similar to that of FIG. 12, with the dispenser tube and spring activation means having been removed from being in place.

First, it is to be noted that each dispenser 12 comprises a generally cylindrical outer sleeve 70 which, for practical purposes, is molded in two halves, as seen in FIGS. 12 and 13. Each dispenser 12 also comprises a substantially cylindrical dispenser tube 72. Each of the outer sleeve 70 and the dispenser tube 72 has respective first ends 74, 76, and respective second ends 78, 80. First and second end sleeve caps 82, 84, respectively, are provided at the respective first and second ends 74, 78, of the outer sleeve 70. As seen in FIG. 11, the end sleeve caps 82, 84, have a truncated cone configuration. Within the dispenser 12, there is found a spring activation means 86.

Referring specifically to FIGS. 12 and 13, the internal construction of each dispenser 12 is now described. The interior wall of the outer sleeve 70 has a first recess 88 which is formed therein near the first end 74. First and second bearing rings 90, 92, are formed at each end of the outer sleeve 70, and a third bearing ring 94 is formed at the end of the first recess 88 which is distal from the first ends 74. A pair of wedge shaped guide probes 96 extend from the second end 78 of the outer sleeve 70, and when the outer sleeve seven is assembled they will be arranged so as to be 180° from each other. It will also be noted that the length of the dispenser tube 76 is greater than the combined length of the outer sleeve 70 and the end sleeve caps 82, 84, so that a portion of the dispenser tube 72 extends outwardly from each end of the outer sleeve 70.

A stop ring 98 is formed on the outer surface of the dispenser tube 72 in a location so that it will be received into the first recess 88. The stop ring 98 will cooperate with the side of the third bearing ring 94 which is closest to the first end 74 of the outer sleeve 70, so as to limit the sliding motion of the dispenser tube 72 in a direction towards the second end 78 of the outer sleeve 70.

The spring activation means 86 is a coil spring which is compressed into the first recess 88, and which surrounds a portion of the outer perimeter of the dispenser tube 72. The spring activation means 86 acts so as to bias the position of the dispenser tube 72 in a direction towards the second end 78 of the outer sleeve 70, due to the fact that the coil spring has been compressed into the first recess 88.

There is a pair of guide slots 100 which is formed lengthwise in the dispensing tube 72 at the second end 80 thereof, and each of the guide slots 100 extends towards the first end 76 of the dispenser tube 72 to a position which is near the mid-point of the length of the outer sleeve 70. A portion 102 of the guide slots 100 is adapted to receive the respective guide probe 96 therein. It is also noted that the end of each portion of each guide slot which is closest to the second end of the dispenser tube is adapted to cooperate with the respective guide probe 78 so as to force the outer end of each respective guide slot 100 to spread apart when the second end 80 of the dispenser tube 72 is pressed so as to cause movement of the dispenser tube 72 inside and along the outer sleeve 70 and the end caps 82, 84 towards the first end 74 of the outer sleeve 70. It will be understood, and it is obvious, that pressing the second end 80 of the dispenser tube 72 with sufficient force will overcome the bias force of the spring activation means 86.

There is also a second pair of slots 104 which is formed lengthwise in the dispensing tube 72 in positions which are intermediate of the pair of guide slots 100. The slots 102 are formed to the same length as the guide slots 100.

There is an interference ring 106 which is formed on the outer surface of the dispenser tube 72 near the second and 80 thereof, and its purpose is to limit the sliding motion of the dispenser tube 72 in a direction towards the first end 74 of the outer sleeve 70. A conical wedge surface 108 is formed which slopes inwardly from the side of the interference ring 106 closest to the second and 80 of the dispenser tube 72, towards the second end 80. There is also a mating wedge surface 110 which is formed on the inner surface of the second end sleeve 84. That surface 110 slopes outwardly from near the end surfaces of the second end sleeve 84, and away therefrom.

Figure 14:
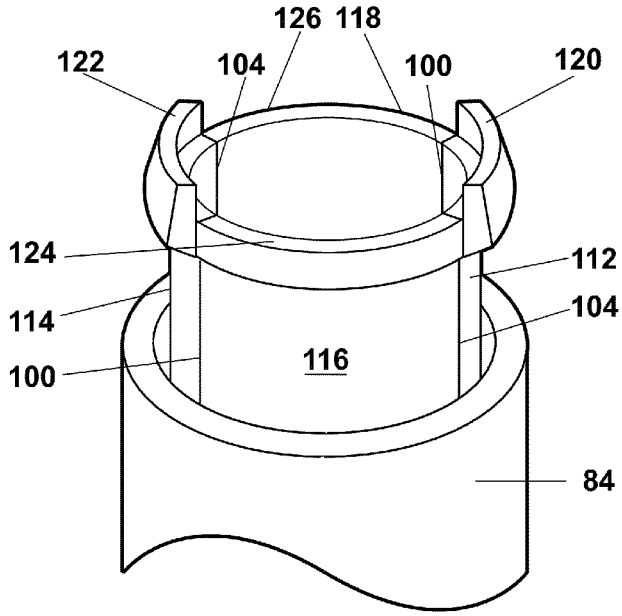
FIG. 14 is a sketch of the dispensing end of a dispenser with the segments at the dispensing end of the dispenser tube arranged in a non-dispensing condition.
Figure 15:
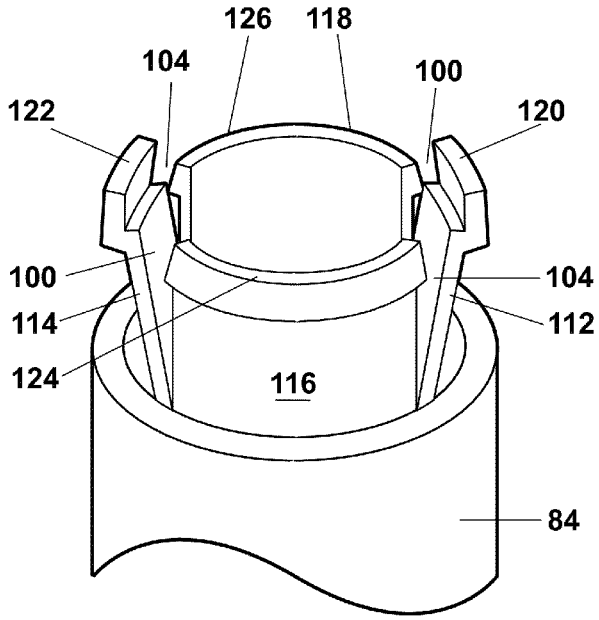
FIG. 15 is a sketch similar to FIG. 14, showing the segments at the dispensing end of the dispenser having been put into their dispensing condition.

Referring specifically to FIGS. 11, 14, and 15, it will be seen that segments 112, 114, 116, and 118, are formed in the dispenser tube 72 between the guide slots 100 and the slots 104. A first pair of segments 112, 114, has end surfaces 120 and 122, respectively; and the other pair of segments 116, 118, has the end surfaces 124 and 126, respectively. The end surfaces 122 and 120 of the segments 112 and 114 extend further away from the second end of the sleeve 70 and from the outer end of the second end sleeve 84 than the end surfaces 124 and 126 of the segments 116 and 118.

Now, it can be seen that the cooperation between the conical wedge surface 108 and the mating wedge surface 110, together with the bias force of the spring activation means 86, acts to maintain the segments 112, 114, 116, and 118, in contiguous positions as seen particularly in FIG. 14. Thus, the dispenser 12 is in its non-dispensing condition when the segments 112, 114, 116, and 118, are contiguous as seen in FIGS. 11, 12, 13, and 14.

However, when any dispenser 12 is activated, whereby the dispenser tube 72 moves towards the first end 74 of the outer sleeve 70 and towards the first end sleeve 82, and also moves against the bias force of the spring activation means 86, then the cooperation between the conical wedge surface 108 and the mating wedge surface 110 is overcome. Thus, the contiguous segments 112, 114, 116, and 118, are permitted to spread apart one from the other, as is seen in FIG. 15. In this disposition, the dispenser 12 is said to be in its dispensing condition.

As noted above, the inside diameter of each dispenser tube 72 will be formed to a predetermined dimension, so as to thereby accommodate only the coloured circular discs 18 which have a corresponding diameter.

Each dispenser tube 72 is typically translucent or transparent. Accordingly, a viewing slot 130 is formed lengthwise along a portion of the outer sleeve 70 between the second and third bearing rings 92, 94, so as to permit viewing of the circular discs 18 which may be stacked inside the dispenser tube 70. This is shown particularly in FIG. 11.

Moreover, the dispenser tube 72 of each respective dispenser 12 will be of the same colour as the coloured discs 18 which are to be accommodated therein.

When each dispenser 12 is assembled in the manner shown in FIG. 11, the end surfaces 120 and 122 of segments 112 and 114 extend beyond the ends of the second pair of segments 116 and 118. Moreover, the second pair of segments 116 and 118 is thus aligned with the viewing slot 130. When the dispenser 12 is activated by pressing the end surfaces 120 and 122 against the planar magnetic surface 24, and is maintained in that disposition while being moved along the planar magnetic surface 24, then a plurality of circular discs 18 may be dispensed therefrom, seriatim, as seen at 140 in FIG. 4.

Other modifications and alterations may be used in the design and manufacture of the apparatus of the present invention without departing from the spirit and scope of the accompanying claims.

Thus, it is apparent that there has been provided, in accordance with the present invention, a child's activity toy, disc dispenser and disc sorting system, which fully satisfies the goals, objects, and advantages set forth hereinbefore. Therefore, having described specific embodiments of the present invention, it will be understood that alternatives, modifications and variations thereof may be suggested to those skilled in the art, and that it is intended that the present specification embrace all such alternatives, modifications and variations as fall within the scope of the appended claims.

Additionally, for clarity and unless otherwise stated, the word "comprise" and variations of the word such as "comprising" and "comprises", when used in the description and claims of the present specification, is not intended to exclude other additives, components, integers or steps.

Moreover, the words "substantially" or "essentially", when used with an adjective or adverb is intended to enhance the scope of the particular characteristic; e.g., substantially planar is intended to mean planar, nearly planar and/or exhibiting characteristics associated with a planar element.

Also, unless otherwise specifically noted, all of the features described herein may be combined with any of the above aspects, in any combination.

Further, use of the terms "he", "him", or "his", is not intended to be specifically directed to persons of the masculine gender, and could easily be read as "she", "her", or "hers", respectively. Similarly, use of terms such as top, bottom sides, front, back, and the like, are used to describe the relative positioning of various components, when the described device is used in its normal configuration.

Finally, while this discussion has addressed prior art known to the inventor, it is not an admission that all art discussed is citable against the present application.

What is claimed is:

1. A dispenser for dispensing circular discs onto a flat surface, when activated, comprising:

a generally cylindrical outer sleeve and a substantially cylindrical dispenser tube, each having a first end and a second end; first and second end sleeve caps at the respective first and second ends of the outer sleeve, each having a truncated cone configuration; and spring activation means;

wherein the interior wall of the outer sleeve has a first recess formed therein near the first end, first and second bearing rings formed at each end of the outer sleeve, and a third bearing ring formed at the end of the first recess distal from the first end; and a pair of wedge shaped guide probes extending from the second end of the outer sleeve, and arranged 180° from each other;

wherein the length of the dispenser tube is greater than the combined length of the outer sleeve and the end sleeve caps;

wherein a stop ring is formed on the outer surface of the dispenser tube in a location so as to be received into said first recess, and so as to cooperate with the side of the third bearing ring closest to the first end of the outer sleeve so as to limit the sliding motion of the dispenser tube in the direction towards the second end of the outer sleeve;

wherein the spring activation means is a coil spring fitted into the first recess and surrounding a portion of the outer perimeter of the dispenser tube so as to bias the position of the dispensing tube in a direction towards the second end of the outer sleeve;

wherein a pair of guide slots is formed lengthwise in the dispenser tube at the second end thereof, and each extends towards the first end to a position near the mid-point of the length of the outer sleeve, and a portion of the guide slots is adapted to receive the respective guide probe therein, and wherein the end of each portion of the guide slot closest to the second end of the dispenser tube is adapted to cooperate with the respective guide probe to force the outer end of each respective guide slot to spread apart when the second end of the dispenser tube is pressed so as to cause movement thereof along the outer sleeve and the end sleeve caps towards the first end of the outer sleeve against the bias force of the spring activation means;

wherein a further pair of slots is formed lengthwise in the dispenser tube in positions intermediate of the pair of guide slots, and to the same length of the guide slots;

wherein an interference ring is formed on the outer surface of the dispenser tube near the second end thereof so as to limit the sliding motion of the dispenser tube in a direction towards the first end of the outer sleeve; and a conical wedge surface is formed sloping inwardly from the side of the interference ring closest to the second end, towards the second end; and wherein a mating wedge surface is formed on the inner surface of the second end sleeve, sloping outwardly from near the end surface of the second end sleeve and away therefrom; and wherein the end surfaces of the first pair of segments thereof which are opposite each other extend further away from the second end of the second end sleeve than the end surfaces of the second pair of segments thereof which are opposite each other and intermediate of the first pair of segments;

whereby the cooperation between the conical wedge surface and the mating wedge surface together with the bias force of the spring activation means, acts to maintain the segments at the second end of the dispenser tube in contiguous positions and thereby so that the dispenser is in its non-dispensing condition; and so that upon activation of the dispenser so as to cause movement of the dispenser tube towards the first end of the outer sleeve and the first end sleeve, against the bias force of the spring activation means, the cooperation between the conical wedge surface and the mating wedge surface is overcome so that the contiguous segments are permitted to spread apart one from the other, and thereby so that the dispenser is in its dispensing condition.

2. The dispenser of claim 1, wherein the inside diameter of the dispenser tube is formed to a predetermined dimension so as to accommodate circular discs of a corresponding diameter.

3. The dispenser of claim 2, wherein the dispenser tube is translucent or transparent, and;

wherein a viewing slot is formed lengthwise along a portion of the outer sleeve between the second and third bearing rings, so as to permit viewing of circular discs that may be stacked in the dispenser tube.

4. The dispenser of claim 3, wherein each circular disc accommodated in the respective dispenser tube has a specific colour applied to the top and bottom surfaces thereof, and wherein the colour of the dispenser tube is the same colour.

5. The dispenser of claim 4, wherein each circular disc accommodated therein is made from a material which is susceptible to magnetism.

6. The dispenser of claim 4, wherein one of the second pair of segments of the dispenser tube is aligned with the viewing slot, so that when the dispenser is activated and moved along the flat magnetic surface, a plurality of circular discs is dispensed therefrom, seriatim.

7. In combination, at least one dispenser of claim 6 and a flat magnetic surface incorporated into a frame so as to form a child's activity toy.

8. The combination of claim 7, having a plurality of dispensers of claim 6, each having a dispenser tube with the differing interior diameter than the other dispensers, and each accommodating a plurality of circular discs having a corresponding colour to the respective dispenser tube therein.

9. The combination of claim 8, wherein the frame has a graduated sorter placed therein below the flat magnetic surface;

wherein a collector slot is placed at one side of the flat magnetic surface in communication with a collector chute in the graduated sorter, and a collection chamber is in communication with the collector chute, so that when the frame is in a horizontal disposition, and the circular discs are pushed through the collector slot, they will fall into the collection chute; and when the frame is in a vertical disposition with the collector chute at the top, the circular discs will fall into the collection chamber;

wherein a plurality of sorting chambers is placed below the collection chamber, and are separated from each contiguous sorting chamber by a separator having a plurality of holes therein, wherein the holes in each consecutive separator are smaller than in the separator which is next above, and wherein the diameters of the respective holes in the respective separators are sufficient to allow all circular discs to fall therethrough except the discs of the specific diameter which is larger than the diameter of the holes in that specific separator;

whereby upon gentle shaking of the frame, all circular discs which are in the collection chamber will be sorted into the respective sorting chambers, with all circular discs of a specific diameter and colour being sorted into their respective sorting chamber.

10. The combination of claim 9, wherein a plurality of compartments are formed in the frame on the opposite side of the dispensing separator, where each compartment accommodates a specific dispenser for a specific designated colour;

wherein a plurality of sliding gate latches is placed in a dispensing separator so as to allow communication between each respective specific dispenser and its respective sorting chamber;

wherein the lengthwise dimension of each compartment is predetermined so as to activate the dispensers, and so that each dispenser is in its dispensing condition;

whereby when the frame is turned into a vertical disposition with the compartments and respective dispensers at the bottom, all the circular discs in any sorting chamber in which the gate latch has been moved to its open position will fall into the respective dispensing tube of each respective dispensing tube of each respective dispenser; and whereby removal of any dispenser from its respective compartment will de-activate that dispenser so that it will assume its non-dispensing condition.

* * * * *